US005152051A

United States Patent [19]

Folk et al.

[11] Patent Number: 5,152,051

[45] Date of Patent: Oct. 6, 1992

[54] TOOL FOR TERMINATING AN ELECTRICAL CABLE TO A CONNECTOR

[75] Inventors: Kenneth F. Folk, Harrisburg; Marlin R. Schollenberger, Myerstown, both of Pa.; James L. Dale, Lawrenceville, Ga.

[73] Assignee: AMP Incorporated, Harrisburg, Pa.

[21] Appl. No.: 692,858

[22] Filed: Apr. 29, 1991

[51] Int. Cl.[5] ..... H01R 43/04

[52] U.S. Cl. ..... 29/749; 29/758; 81/364

[58] Field of Search ..... 29/747, 748, 749, 758; 81/364, 314, 341

[56] References Cited

U.S. PATENT DOCUMENTS 2,861,489 11/1958 Barnes ..... 81/314 X 4,070,754 1/1978 Bauerkemper ..... 29/749

*Primary Examiner*—Carl E. Hall

*Attorney, Agent, or Firm*—James M. Trygg

[57] ABSTRACT

A hand operated tool for terminating the conductors of a hybrid cable to insulation displacement contacts contained in a connector. The tool includes a ratchet actuated cam which drives a ram and presser plate toward an abutting member upon which the connector assembly is secured. Free ends of the abutting member pass through the connector housing to provide adequate support. The free ends are then structurally supported by a bar that can be latched in place during operation of the tool. An interlock precludes operation of the tool without the support bar being in place. The operable handle which drives the ratchet is automatically disengaged when the ram has advanced to its fullest. A release mechanism provides for return of the ram to its starting position.

9 Claims, 8 Drawing Sheets

TOOL FOR TERMINATING AN ELECTRICAL CABLE TO A CONNECTOR

The present invention relates to a tool for terminating the conductors of an electrical cable deployed in a structure to contacts in a wall box outlet assembly to be mounted on the structure.

BACKGROUND OF THE INVENTION

In light frame structures, such as houses, wires are conventionally deployed prior to the assembly of wall panels. Applicable codes require that wall or outlet boxes, which are part of the original wiring, be secured to structural studs. Standard practice is for the boxes to be nailed to the studs at desired locations prior to positioning the drywall. The positions of the boxes are marked and holes cut in the drywall. Outlets, switches and other components are then attached to the wires and positioned within the outlet boxes. Faceplates or other covers are then assembled. Such structures and methods are becoming obsolete and are being replaced with more modern systems such as hybrid cables containing both power and signal conductors. Such a system is disclosed in U.S. patent application Ser. No. 07/618,766, which was filed on Nov. 27, 1990 and assigned to the present assignee, and is hereby incorporated by reference as though set forth verbatim herein. This system includes a convenience outlet assembly having a wall box which can be mounted to a stud in light frame construction and is suitable for use with hybrid cables containing both power and signal conductors. The assembly includes a mounting bracket attachable to a stud and a wall box which can be attached to the mounting bracket with a peripheral frame on the front of the wall box being precisely positioned relative to the exterior of a wall panel, even though the position of the mounting bracket can vary. A cable tap subassembly is attachable to provide for interconnection of various modules in the assembly. This cable tap subassembly can be part of the rear wall of the housing.

When terminating the conductors of such a hybrid cable to contacts in the outlet assembly, the cable is pulled through an opening in the wall surface, the various parts of the outlet assembly are assembled into position embracing the cable, and the assembly pressed together so that insulation displacement contacts contained in the outlet assembly, pierce the insulation of the cable and make good electrical contact with their respective conductors. One problem associated with this procedure is that the working area is limited due to the size of the outlet assembly and the limited slack in the cable. Another problem is that significant pressure is required to effect a proper termination and therefore the parts of the outlet assembly that contain the contacts must be adequately supported by the termination tool.

What is needed is a tool which can be maneuvered in close quarters, fully support and back up the contacts, and apply sufficient pressure to effect the desired termination without undue tool deflection.

SUMMARY OF THE INVENTION

The present invention is a hand operated tool for terminating conductors of electrical wires to insulation displacement contacts contained in a connector. The tool has a frame, a manually operable handle attached to the frame, and an abutting means extending from one end of the frame, in cantilever fashion, and terminating in a free end for securing and positioning the connector. A ram is carried by the frame and is operable by the handle to move in a direction toward the abutting means. A closure means is releasably attachable to the free end or to the frame for securing the free end to the frame after the connector is secured and positioned by the abutting means. By operation of the handle, the ram moves toward the abutting means pressing the connector therebetween and thereby terminating the conductors to the contacts.

DESCRIPTION OF THE PREFERRED EMBODIMENT

Figure 1:
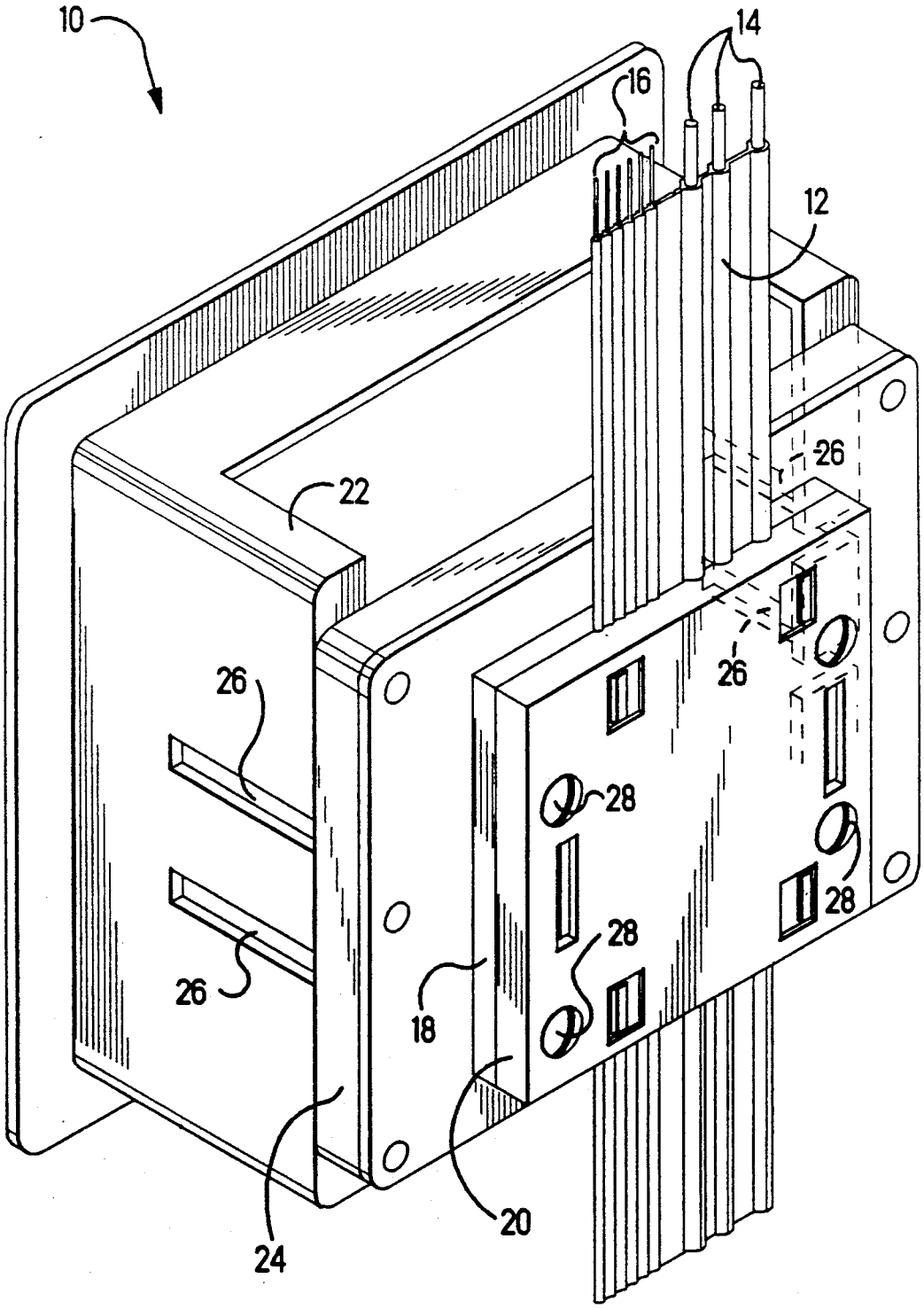
FIG. 1 is an isometric view of a connector outlet assembly and hybrid cable to be terminated.
Figure 2:
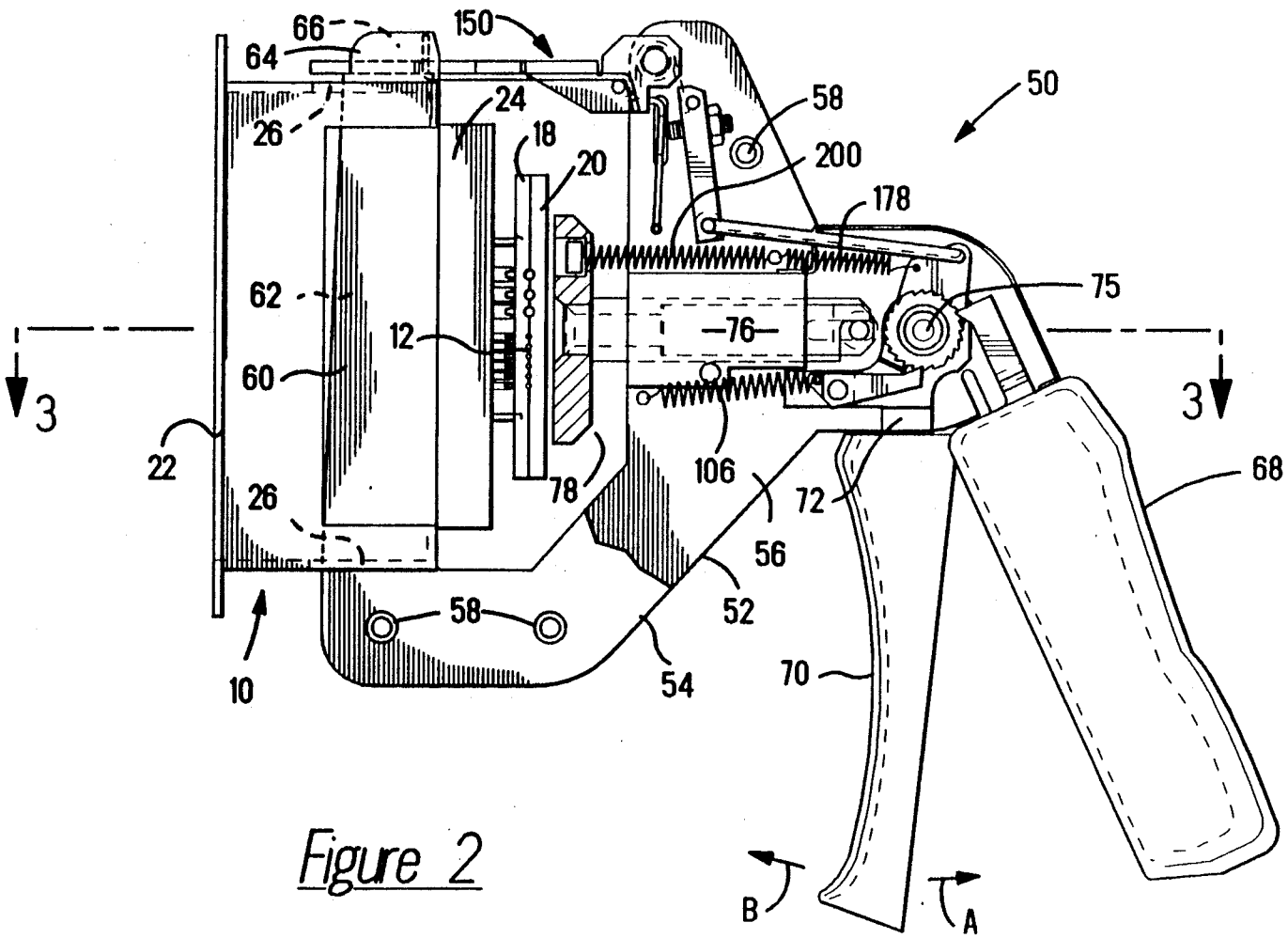
FIG. 2 is a front view of a tool incorporating the teachings of the present invention.

There is shown in FIG. 1 a connector outlet assembly 10 terminated to a hybrid cable 12 containing both power conductors 14 and data or signal conductors 16. The connector 10 includes the two halves of a cable clamp 18 and 20 which are positioned on opposite sides of the cable 12, as shown in FIG. 1, an outlet box 22, and a cable tap 24 containing the insulation displacement contacts, not shown, that are terminated to the conductors 14 and 16. This connector outlet assembly 10 and its assembly will be described only briefly here. If more detailed information relating thereto is desired, the above referenced '766 patent application, which contains a thorough description of this connector assembly and its use, may be consulted. In any case, the connector outlet assembly 10 is assembled and terminated to the cable 12 by temporarily snapping the cable clamp halves 18 and 20 together with the cable 12 sandwiched in between, and that assembly snapped together with the cable tap 24 which is already attached to the outlet box 22. The snapping action is provided by resilient plastic parts which latch together when assembled to temporarily hold the parts together and aid in alignment and final assembly of the parts. Note that the outlet box 22 has a pair of slots 26 formed through two opposite side walls. The purpose of these slots will be described below. The snapped together assembly is then positioned on the terminating tool, as shown in FIG. 2, and the tool actuated to effect the desired termination. Before removing the assembly from the tool, four screw fasteners 28 are inserted into threaded holes to achieve a rigid assembly.

There is shown in FIG. 2 a hand tool 50 with the connector outlet assembly 10 in position for termination of the conductors 14 and 16. The view is shown in partial cross section so that the key operating elements may be seen. For best clarity FIGS. 2 and 3 should be viewed together, FIG. 3 being a view taken along the lines 3—3 of FIG. 2. The tool 50 includes a frame 52 consisting of a pair of parallel plates 54 and 56 which are rigidly joined by means of the spacers with peened ends indicated at 58. Each of the plates 54,56 has an extended portion, or rail, 60 and 62 respectively that extends from the frame 52 in cantilever fashion and terminates in the free ends 64 and 66 respectively. The extended portions 60 and 62 are spaced apart to correspond to the spacing of the slots 26 in the outlet box 22. Further, the slots 26 are sized so that the portions 60 and 62 may extend completely through the box 22 as shown in FIG. 2. The spacing of these slots is chosen so that the various parts of the connector outlet assembly 10 are adequately supported during the termination process. A fixed handle 68 is rigidly attached to the frame 52 as shown. A movable handle 70 includes a pair of parallel plates 72,74 which extend within the frame 52 between the plates 54 and 56 and are pivotally attached thereto by means of a shaft 75. The movable handle 70 is arranged to pivot toward and away from the fixed handle 68 as indicated by the arrows A and B of FIG. 2. A ram 76 having a presser plate 78 attached to one end thereof is arranged to undergo reciprocating motion within the frame 52 in a direction toward and away from the extended portions 60 and 62. As will be described in detail below, actuation of the movable handle 70 causes the ram 76 and presser plate 78 to move toward the left, as viewed in FIG. 2, engage the cable clamp 20, and force the cable tap 24 into abutting engagement with the extended portions 60 and 62, thereby terminating the conductors 14 and 16 of the cable 12 to the insulation displacement contacts contained within the cable tap 24. Note that the extended portions 60 and 62 form abutting members against which the cable tap 24, cable clamp halves 18 and 20, and the cable 12 are forced by the ram 76 and presser plate 78.

Figure 3:
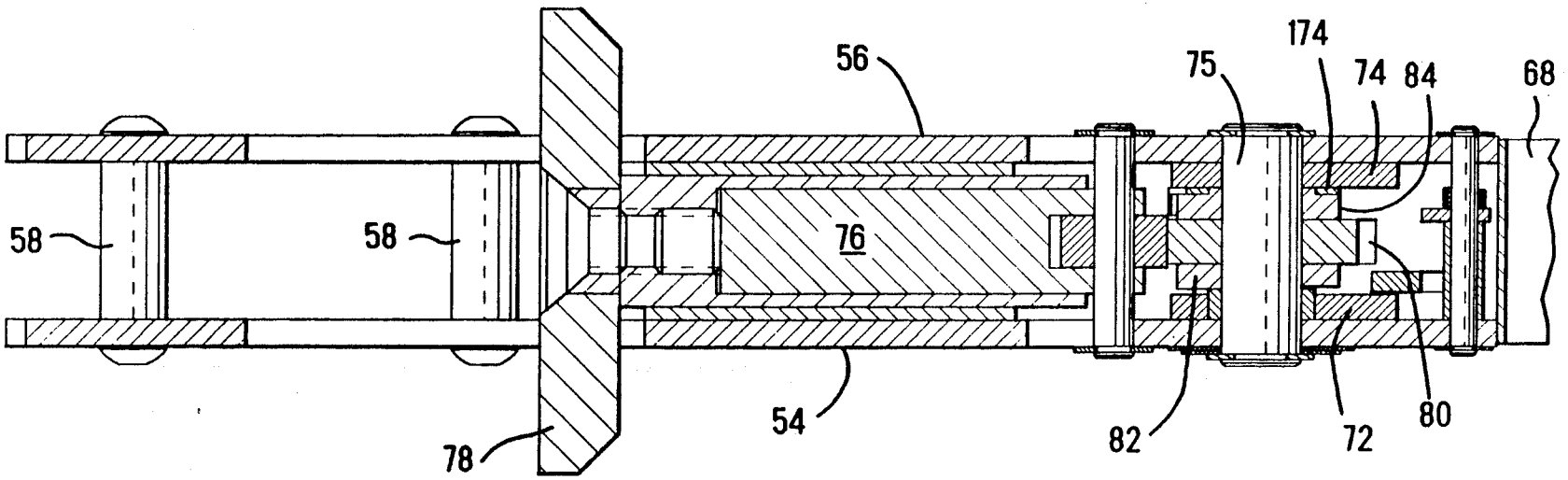
FIG. 3 is a top cross-sectional view taken along the lines 3—3 of FIG. 2.
Figure 4:
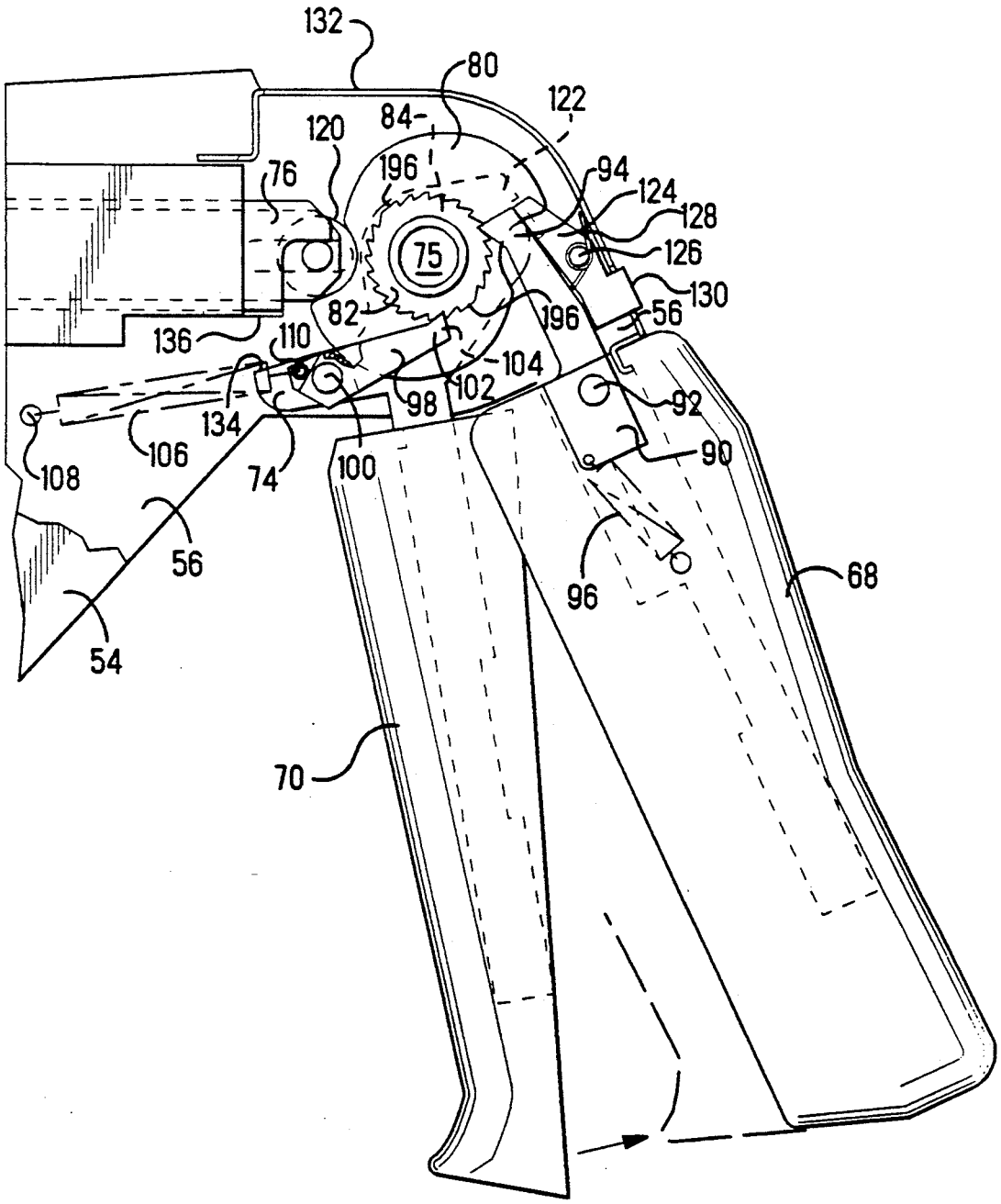
FIGS. 4 through 7 are partial cross-sectional views, similar to FIG. 2, showing a portion of the tool in various states of operation.

Details of the tool actuating mechanism and its operation are best shown in FIGS. 4 through 7. A two lobe cam 80 is journaled for rotation on the shaft 75. A pair of toothed wheels 82 and 84 are attached to either side of the cam 80 and rotate therewith as a single rigid assembly. A holding pawl 90 is pivotally attached to the frame 52 at the point 92 and has an end 94 in operational engagement with the toothed wheel 84. A spring 96 is arranged to keep the pawl 90 in such engagement. A driving pawl 98 is pivotally attached to the plates 72 and 74 by means of the pivot 100. The pawl 98 is a U-shaped member which straddles the cam 80 having an end 102 on one side thereof in operational engagement with the toothed wheel 82 and an end 104 on the other side thereof in operational engagement with the toothed wheel 84. A spring 106, one end of which is attached to the frame 52 at 108 and the other end of which is attached to the drive pawl 98 at 110, serves to both keep the drive pawl 98 in operational engagement with the toothed wheels 82 and 84 and urge the movable handle 70 away from the fixed handle 68. The spring 106 urges the movable handle to its primary position, shown in FIG. 4, where further movement is prevented by a tab 122 which projects from the plate 74 and engages a locking member 124. The locking member 124 is pivotally attached to the plate 56 at 126. A torsion spring 128 is arranged on the pivot 126 to urge the lock member 124 counterclockwise, as viewed in FIG. 4, and into engagement with the tab 122. A portion 130 of the locking member 124 projects through an opening in a sheet metal cover 132 and can be depressed by the operator so that the member 124 clears the tab 122. When this is done, the spring 106 urges the movable handle 70 further away from the fixed handle to its secondary position shown in FIG. 7. Note that further movement is prevented by a pair of stops 134 on the plates 74 and 76 which engage the frame 52 at 136. A cam follower 120 is attached to the ram 76 and is in operational engagement with the cam 80 as shown in FIGS. 3 and 4. In the present example, the follower 120 is a roller which is journaled for rotation in the ram 76 to reduce friction. However the follower could be fixed.

Figure 8:
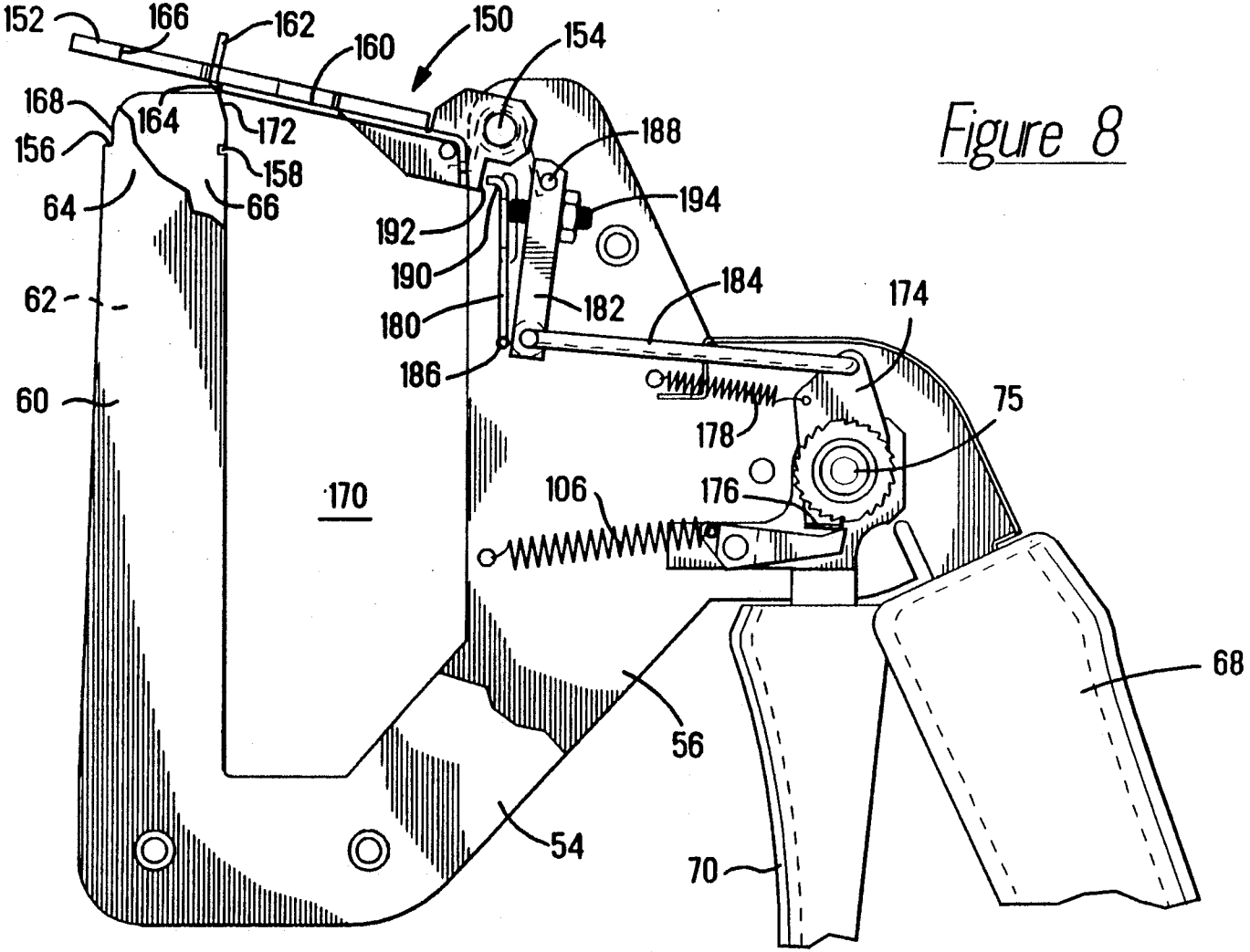
FIG. 8 is a view similar to that of FIG. 2 showing the closure interlock mechanism.

A closure mechanism 150, shown in FIGS. 2 and 8, has a bar 152 that is pivotally attached to the plates 54 and 56 at the pivot 154 and is releasably attachable to the free ends 64 and 66. Each of the free end 64 and 66 includes a notch 156 and a groove 158. A slide 160 having an upwardly turned tab 162 is arranged to slide back and forth along the bar 152 and is urged in a direction away from the pivot 154 by a spring, not shown. The slide 160, being captive to the bar 152, includes a latch 164 that is sized to fully enter the two grooves 158 when the closure mechanism 150 is in its closed position, as shown in FIG. 2. The bar 152 includes a pair of ears 166, one ear extending laterally from each side of the bar 152, which engage the surfaces 168 of the free ends 64 and 66 when closed. In this position the spring, not shown, holds the latch 164 in the grooves 158 and the ears 166 in latching engagement with the surfaces 168 thereby structurally tying the free ends 64 and 66 to the frame 52. By manually pushing the tab 162 toward the pivot 154, the latch 164 disengages the grooves 158 and the closure mechanism 150 can be pivoted clockwise to open the throat 170 for removal or insertion of the connector outlet assembly 10. Note that a chamfer 172 is provided on the two free ends 64 and 65 to engage the latch 164 and cam it toward the pivot 154 during manual closing of the closure mechanism 150.

An interlock mechanism is provided to disengage the drive pawl 98 from the toothed wheels 82 and 84 whenever the closure mechanism 150 is not latched in its closed position. This interlock mechanism includes a plate 174 arranged to pivot about the shaft 75 and having a laterally formed tab 176 which will move the drive pawl 98 away from the toothed wheels when the plate 174 is pivoted counterclockwise as shown in FIG. 8. A spring 178 is arranged to urge the plate 174 into this position. A pair of pivotal bars 180 and 182 and a link 184 transfer pivotal movement of the closure mechanism 150 to pivotal movement of the plate 174 to effect the desired interlock. The bars 180 and 182 are pivotally mounted to the frame 52 by the pivots 186 and 188 respectively. The bar 180 has a turned end 190 which engages a downwardly directed abutting surface 192 of the closure mechanism 150. An adjusting screw 194 and lock nut are provided for fine adjustment of the interlock mechanism.

Figure 5:
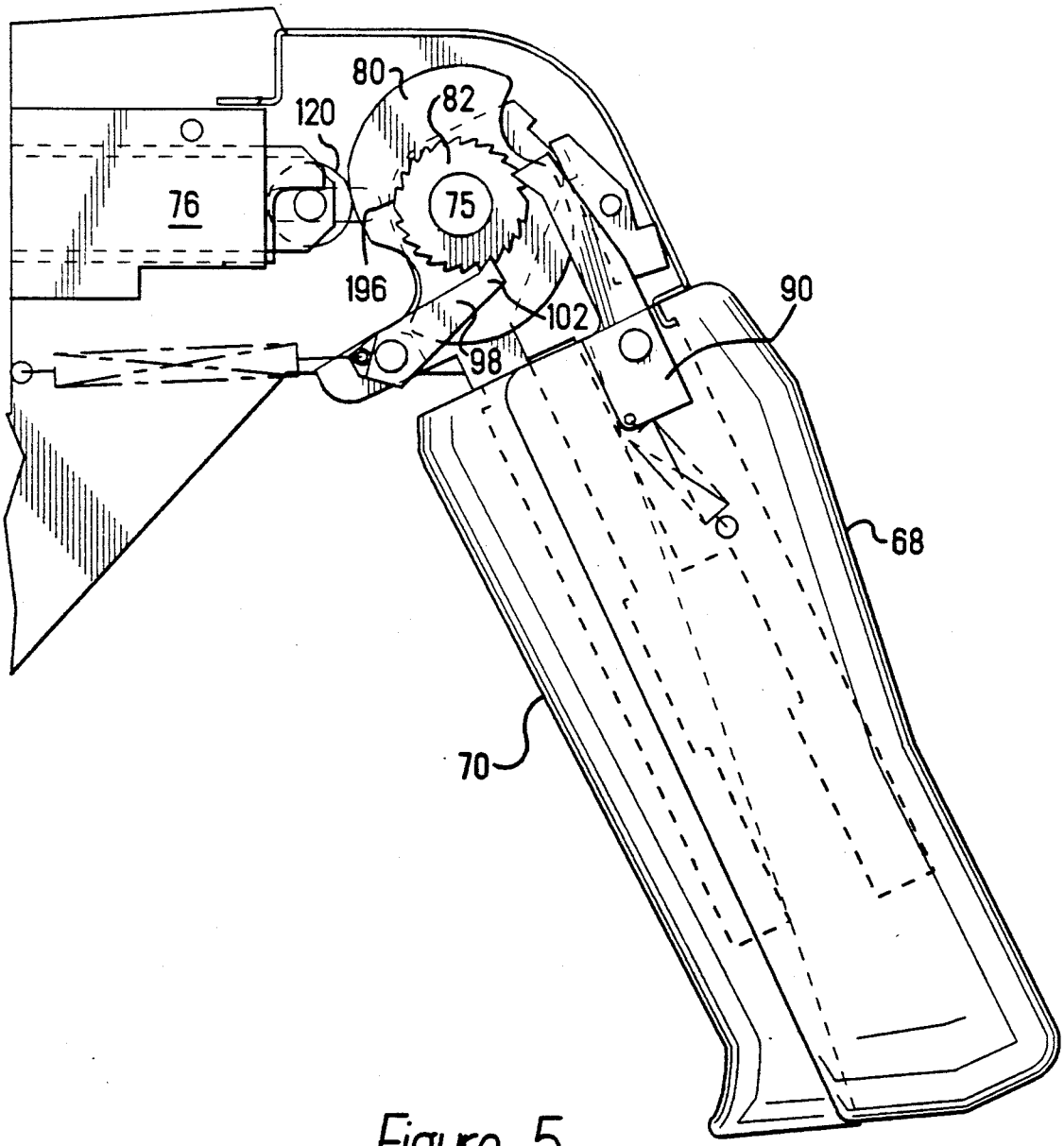
Figure 6:
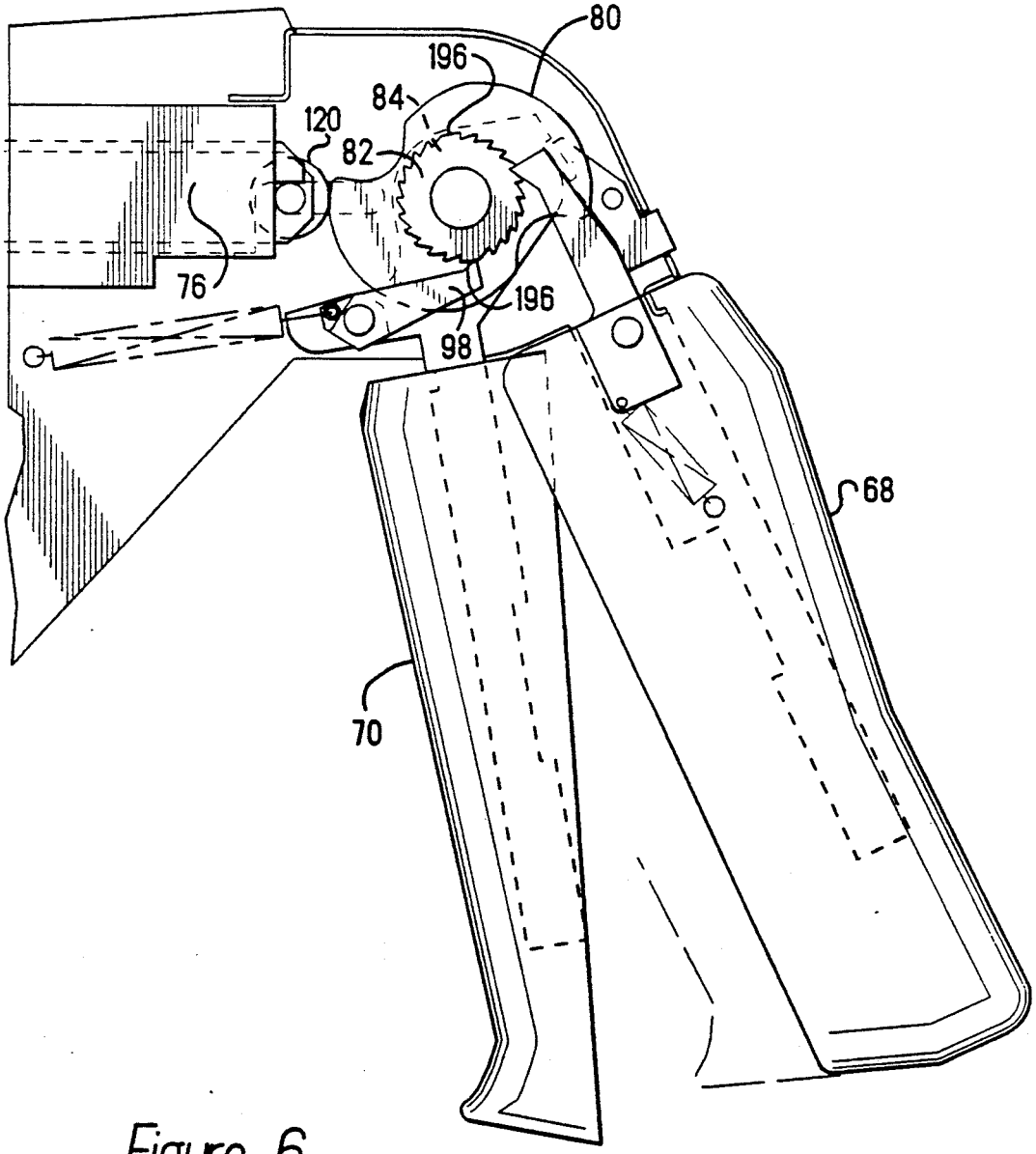
Figure 7:
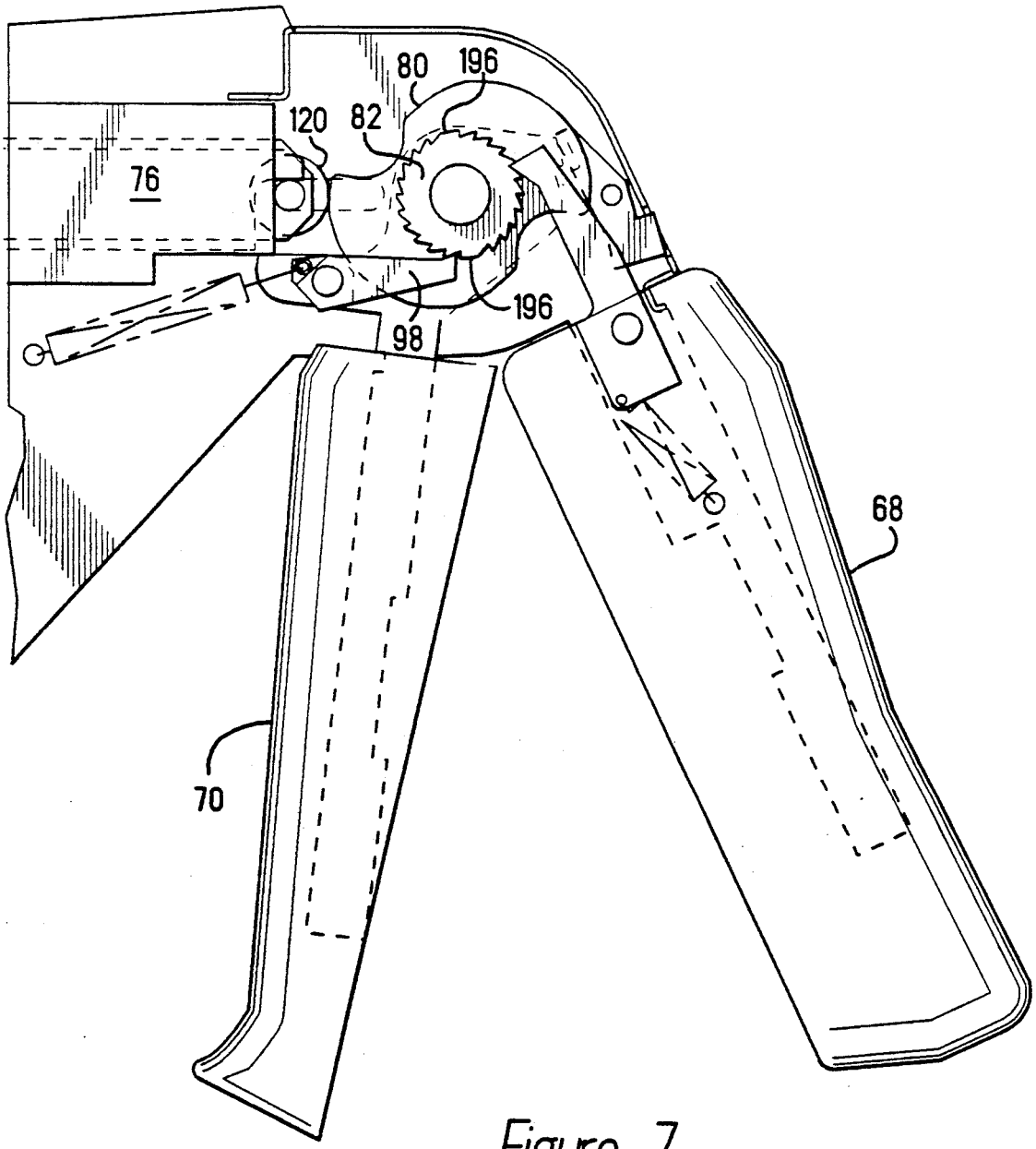

In operation, the closure mechanism 150 is opened by depressing the tab 162 and lifting the bar 152 to open the throat 170. A connector outlet assembly 10 having a cable 12 in place is inserted into the throat 170 by aligning the free ends 64 and 66 with the slots 26 and permitting the free ends to pass completely through the slots so that the extended portions 60 and 62 are adjacent the cable tap 24, as best seen in FIG. 2. The closure mechanism 150 is then closed and latched to the free ends 64 and 66. The ram 76, cam 80, toothed wheels 82 and 84, and associated mechanisms are positioned as shown in FIG. 4. Note that the tooth position 196 adjacent the end 102 of the drive pawl 98 is a null tooth, that is there is no tooth. Similarly, the tooth position 180 degrees away is also a null tooth. These null teeth are on the toothed wheel 82 only. Their purpose will be described below. To begin the termination cycle the movable handle 70 is manually moved toward the fixed handle 68 as shown in FIG. 5. In this way the drive pawl 98 advances the toothed wheels and the cam 80 one tooth position counterclockwise as shown in FIG. 5. The movable handle 70 is manually actuated in a similar manner several more times until one of the null teeth has advanced to a position in engagement with the drive pawl 98, as best seen in FIG. 6. At this point the cam 80 has fully advanced the ram 76 and presser plate 78 toward the rails 60 and 62 thereby terminating the conductors of the cable 12 to the contacts of the connector outlet assembly 10. Further operation of the movable handle 70 will result in movement of the handle with the drive pawl riding on the null tooth 196 without further rotation of the toothed wheels. The four screw fasteners 28 are then secured in place to provide a rigid assembly. In this way, the operator is precluded from inadvertently releasing the pressure of the tool on the terminated connector prior to installing the screws. In order to release the pressure of the ram 76 so that the terminated connector outlet assembly 10 can be removed from the tool 50, the portion 130 of the locking member 124 is depressed so that the member 124 clears the tab 122. The spring 106 then urges the movable handle 70 to move to its secondary position further to the left as shown in FIG. 7. This allows the drive pawl 98 to move past the null tooth 196 and engage the next tooth of the toothed wheels 82 and 84. The movable handle 70 is then actuated once more to advance the cam 80 to the position shown in FIG. 2 where the ram 76 and follower 120 return to their starting position by means of a return spring 200. The reason that the null teeth 196 are not associated with the toothed wheel 84 is that the stop pawl 90 must be able to function in every tooth position. Other ways of nulling a tooth position will occur to those skilled in the art, such as a separate mechanism for lifting the drive pawl from the toothed wheels at a particular tooth position. Such mechanisms are considered to be within the scope of the present invention.

An important advantage of the present invention is that the two rails 60 and 62 fully support the cable tap 24 and distribute the load during termination, although, a single rail having a suitable width could be substituted where the slots 26 are replaced with a suitably positioned wide slot. Additionally, the closure mechanism provides structural support for the free ends of the rails so that the relatively large forces required to effect these terminations can be achieved without requiring a large, heavy and unwieldy structure. The closure mechanism interlock prevents operation of the tool without prior engagement of the closure mechanism. The null tooth and release mechanism has the added advantage of preventing the operator from inadvertently releasing the pressure on the connector assembly prior to installing the screws needed for a rigid assembly.

We claim:

1. A hand tool for terminating the conductors of electrical wires to insulation displacement contacts in a connector comprising:

(a) a frame;

(b) a manually operable handle attached to said frame;

(c) abutting means extending from one end of said frame, in cantilever fashion, and terminating in a free end, for securing and positioning said connector;

(d) a ram carried by said frame and operable by said handle to undergo movement in a direction toward said abutting means;

(e) closure means releasably attachable to said free end of said abutting means or said frame for securing said free end to said frame after said connector is secured and positioned by the abutting means, so that when said handle is operated, said ram moves toward said abutting means pressing said connector therebetween thereby terminating said conductors to said contacts; and (f) interlock means for rendering said ram operable by said handle only when said closure means is attached to secure said free end to said frame.

2. The tool according to claim 1 wherein said movement of said ram is effected by a cam in engagement with a cam follower attached to said ram wherein said cam is rotatable about an axis by means of a ratchet comprising a toothed wheel attached to said cam and a pawl attached to said handle, whereby upon manually operating said handle, said pawl engages said toothed wheel causing said cam to rotate thereby effecting said movement of said ram.

3. The tool according to claim 2 wherein when said closure means is attached to secure said free end to said frame, said pawl is in operational engagement with said toothed wheel and when said closure means is detached, said pawl is spaced from said toothed wheel.

4. The tool according to claim 3 including a linkage operable by said closure means for moving said pawl out of engagement with said toothed wheel when said closure means is detached from said free end or said base.

5. The tool according to claim 4 wherein said linkage includes a tab, pivotal about said axis of said cam, and arranged to engage said pawl and effect said moving, thereof.

6. The tool according to claim 1 wherein manual operation of said handle effects said movement of said ram only until said ram has moved to within a predetermined distance from said abutting means at which time said manual operation of said handle no longer effects said movement of said ram.

7. The tool according to claim 6 wherein said movement of said ram is effected by a cam in engagement with a cam follower attached to said ram, wherein said cam is rotatable about an axis by means of a ratchet comprising a toothed wheel attached to said cam and a pawl attached to said handle in operational engagement with said toothed wheel and arranged so that when said movement of said ram has extended said ram said predetermined amount, said pawl engages a null portion of said toothed wheel and is thereby precluded from further rotation of said toothed wheel.

8. The tool according to claim 1 wherein said abutting means comprises a rail sized to fit into an opening in said connector to effect said securing and positioning so that when said closure means is attached to said free end or to said base, said connector is held captive in position for terminating said conductors to said contacts.

9. The tool according to claim 8 wherein said abutting means further comprises at least two spaced apart rails arranged one on each side of a center line extending from said ram in the direction of said movement thereof thereby providing a stable support for said connector during termination of said conductors to said contacts.

* * * * *